United States Patent [19]

Shimada

[11] Patent Number: 4,625,476

[45] Date of Patent: Dec. 2, 1986

[54] PARTITION WALL

[75] Inventor: Yoshikatsu Shimada, Kiyose, Japan

[73] Assignee: Nihon Shuno System Kabushiki Kaisha, Tokyo, Japan

[21] Appl. No.: 684,074

[22] Filed: Dec. 20, 1984

[30] Foreign Application Priority Data

| | | | |
|---|---|---|---|
| Dec. 27, 1983 | [JP] | Japan | 58-244837 |
| Feb. 16, 1984 | [JP] | Japan | 59-26049 |
| Apr. 25, 1984 | [JP] | Japan | 59-82075 |
| Apr. 25, 1984 | [JP] | Japan | 59-82076 |
| Apr. 25, 1984 | [JP] | Japan | 59-59966[U] |
| Apr. 26, 1984 | [JP] | Japan | 59-83007 |
| Apr. 26, 1984 | [JP] | Japan | 59-83008 |
| Apr. 26, 1984 | [JP] | Japan | 59-83009 |

[51] Int. Cl.[4] ..... E04B 2/82; E04H 1/00

[52] U.S. Cl. ..... 52/126.4; 52/238.1; 52/281; 52/586; 52/204

[58] Field of Search ..... 52/126.1, 126.3, 126.4, 52/126.6, 238.1, 239–243, 243.1, 281, 283–285, 578, 552, 586, 204

[56] References Cited

U.S. PATENT DOCUMENTS

| | | | |
|---|---|---|---|
| 1,458,652 | 6/1923 | Gooding | 52/238.1 |
| 1,723,306 | 8/1929 | Sipe | 52/396 |
| 2,010,294 | 8/1935 | Dovell | 52/126.3 |
| 2,249,203 | 7/1941 | Guignon | 52/238.1 |
| 2,363,405 | 11/1944 | Eichelberger | 52/586 |
| 2,365,255 | 12/1944 | Eager | 52/126.4 |
| 2,844,848 | 7/1958 | Couse et al. | 52/286 |
| 3,251,163 | 5/1966 | Russel | 52/238.1 |
| 3,410,042 | 11/1968 | Averill | 52/243.1 |
| 3,636,671 | 1/1972 | Hollister | 52/126.1 |
| 3,805,471 | 4/1974 | De Schutter | 52/126.4 |
| 4,037,380 | 7/1977 | Pollock | 52/243.1 |
| 4,120,124 | 10/1975 | Temple et al. | 52/126.4 |
| 4,224,769 | 9/1980 | Ball et al. | 52/238.1 |
| 4,258,516 | 3/1981 | Mori et al. | 52/126.6 |
| 4,391,077 | 7/1983 | Giess | 52/586 |
| 4,446,669 | 5/1984 | Siegal | 52/239 |

FOREIGN PATENT DOCUMENTS

| | | | |
|---|---|---|---|
| 1397089 | 3/1965 | France | 52/238.1 |
| 377512 | 6/1964 | Switzerland | 52/243.1 |
| 691209 | 5/1953 | United Kingdom | 52/243.1 |

*Primary Examiner*—John E. Murtagh
*Assistant Examiner*—Andrew Joseph Rudy
*Attorney, Agent, or Firm*—Wegner & Bretschneider

[57] ABSTRACT

A prefabricated partition wall for use in a room having a floor (11) and a ceiling (12), comprises an upper support (30) fixed on the ceiling (12), a lower support (36, 47, 60) fixed on the floor (11), a metallic joint tube (20, 61) extending vertically and having an upper and lower open ends, a fixture (32, 64) for fixing the upper open end of the joint tube (20, 61) to the upper support (30), a plurality of panels (13–17) each having at both edges there of two opposite vertical grooves of a shape corresponding to that of the joint tube (20, 61), an adjustor (35, 46, 53, 67) placed between the lower support (36, 47, 60) and the lower open end of the joint tube (20, 61) for supporting the joint tube (20, 61) and the panels (13–17) at their bottom portion in such a manner that the adjustor (35, 46, 53, 67) can be actuated to adjust the joint tube (20, 61) and the panels (13–17) together in a vertical direction so as to fix securely them in portion between the floor (11) and the ceiling (12).

8 Claims, 31 Drawing Figures

PARTITION WALL

BACKGROUND OF THE INVENTION

1. Field of the Invention

This invention relates to a prefabricated partition wall which can be disassembled so as to be rearranged.

2. Prior Art

Various prefabricated partition walls have been used for partitioning a room. However, such conventional partition walls have the following defects:

(1) A built-in type partition walls cannot be moved or disassembled so as to be rearranged.

(2) Many skilled workmen are required when a built-in type partition wall is arranged in a room.

(3) It is difficult to prevent noise and light from passing a partition wall.

OBJECTS OF THE INVENTION

An object of this invention is to provide a new type of prefabricated partition wall which can be easily assembled and disassembled.

A further object of this invention is to provide a prefabricated partition wall which can be easily set on a floor and a ceiling in a room.

Another object of this invention is to provide a prefabricated partition wall which can have noise and light insulations.

DESCRIPTION OF THE PREFERRED EMBODIMENTS

Figure 1:
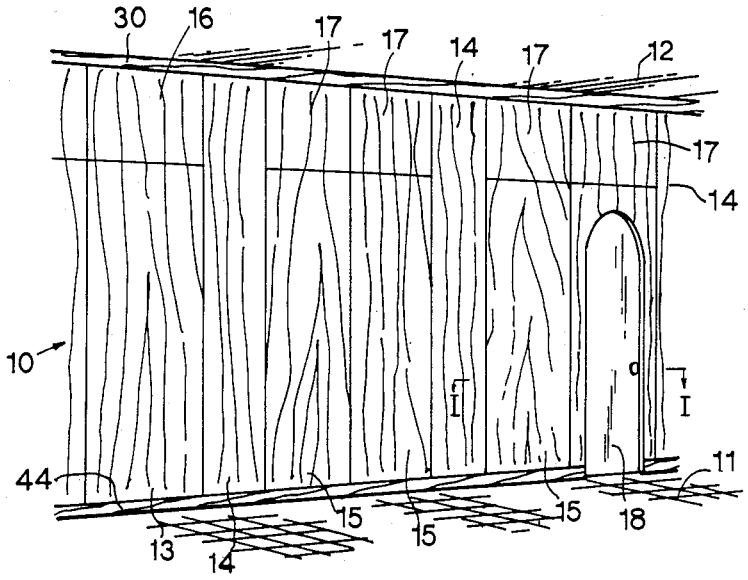
FIG. 1 is a perspective view of a prefabricated partition wall according to a first embodiment of this invention.
Figure 2:
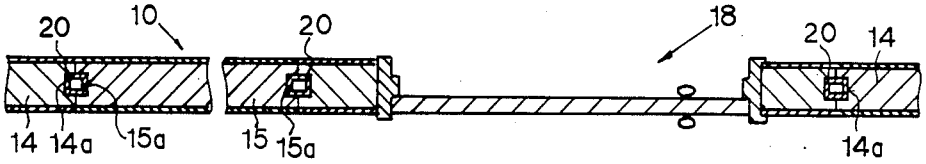
FIG. 2 shows a section taken along the line I—I of FIG. 1.
Figure 3:
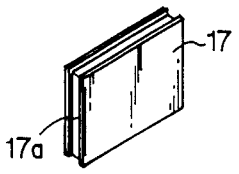
FIGS. 3 to 7 show various panels for a prefabricated partition wall according to this invention.
Figure 4:
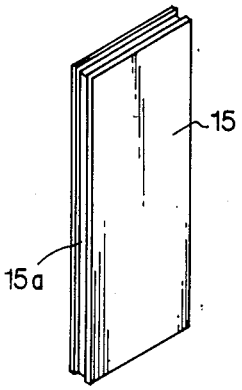
Figure 5:
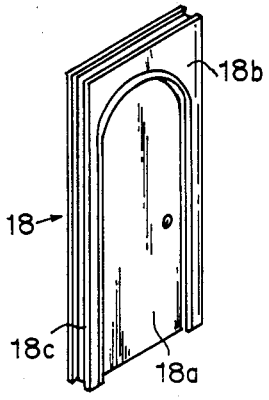

FIGS. 1 to 18 show a partition wall according to a first embodiment of this invention.

Referring to FIGS. 1 to 5, a prefabricated partition wall 10 is securely fixed between a floor 11 and a ceiling 12 so as to partition a room into two sections. The partition wall 10 is assembled but able to be easily disassembled and moved for the purpose of rearranging the room in a desired manner.

The partition wall 10 includes various types of panels 13 to 17 and a door unit 18. If desired, the partition wall 10 may be composed of plural panels having the same size.

The panels 13 to 17 and the door unit 18 are made of wood or woody material. In the illustrated embodiment, the panels 13 to 17 have decorative thin plates at both sides thereof and two vertical grooves 14*a*, 15*a*, 17*a* in both opposite edges through their entire length.

The door unit 18 has a door 18*a* hinged to a panel 18*b* having two vertical grooves 18*c* at its edges.

Figure 6:
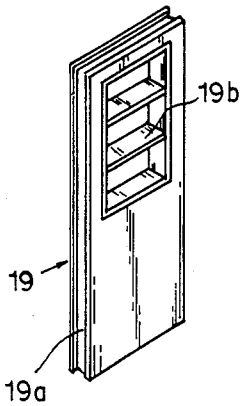
Figure 7:
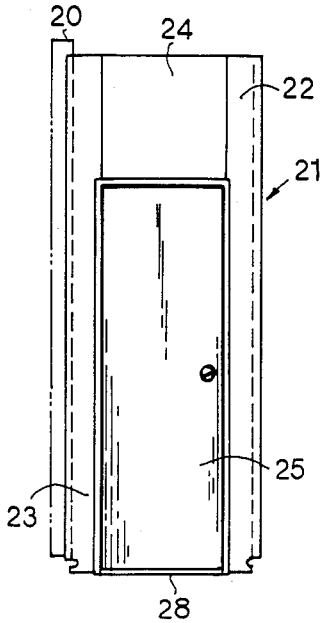
Figure 8:
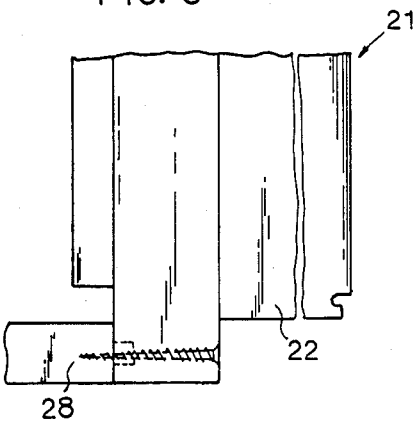
FIG. 8 is an enlarged front view showing a lower corner of a door unit as shown in FIG. 7.
Figure 9:
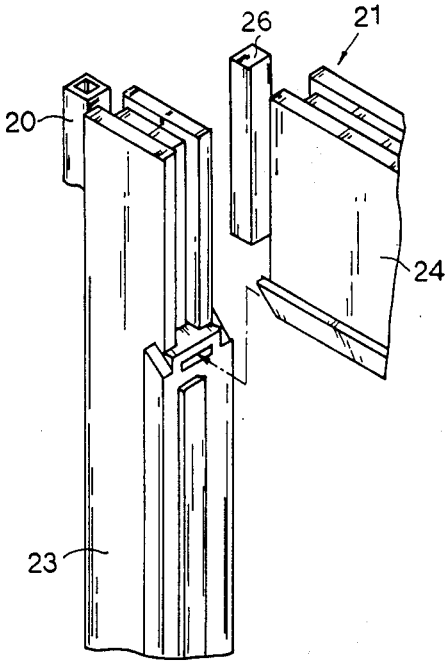
FIG. 9 is an enlarged exploded perspective view showing an upper corner of a door unit as shown in FIG. 7.
Figure 10:
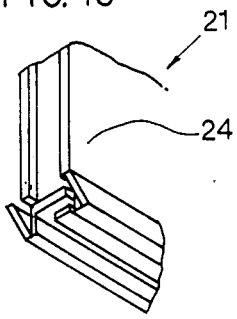
FIG. 10 is an exploded perspective view showing an inner corner portion of a door unit as shown in FIG. 7.

As shown in FIG. 6, a panel 19 has two grooves 19*a* at its edges and shelves 19*b* at its side.

The peripheral shape of the panels 18*b* and 19 is substantially the same as that of the panel 15.

The grooves of the panels 13 to 17 and 18*b* are rectangular in cross-section. A plurality of joint tubes 20 are fitted into the grooves of the panels 13 to 17, 18*b* so as to join them together.

FIGS. 7 to 10 show a large door unit 21 which is composed of two vertical panels 22, 23, an upper horizontal panel 24 and a door 25. The vertical panels 22, 23 and the horizontal panel 24 are joined together by two vertical joint members 26. The door 25 is hinged to a door frame 28 fixed to the inner periphery of the panels 22 to 24.

As best shown in FIG. 1, the panels 13 and 15 are joined to the panels 16 and 17, respectively, by plural horizontal joint members (not shown) of a rectangular shape in section which are fitted into the horizontal grooves of the panels 13, 15 to 17 formed in the upper and/or lower edges thereof.

Figure 11:
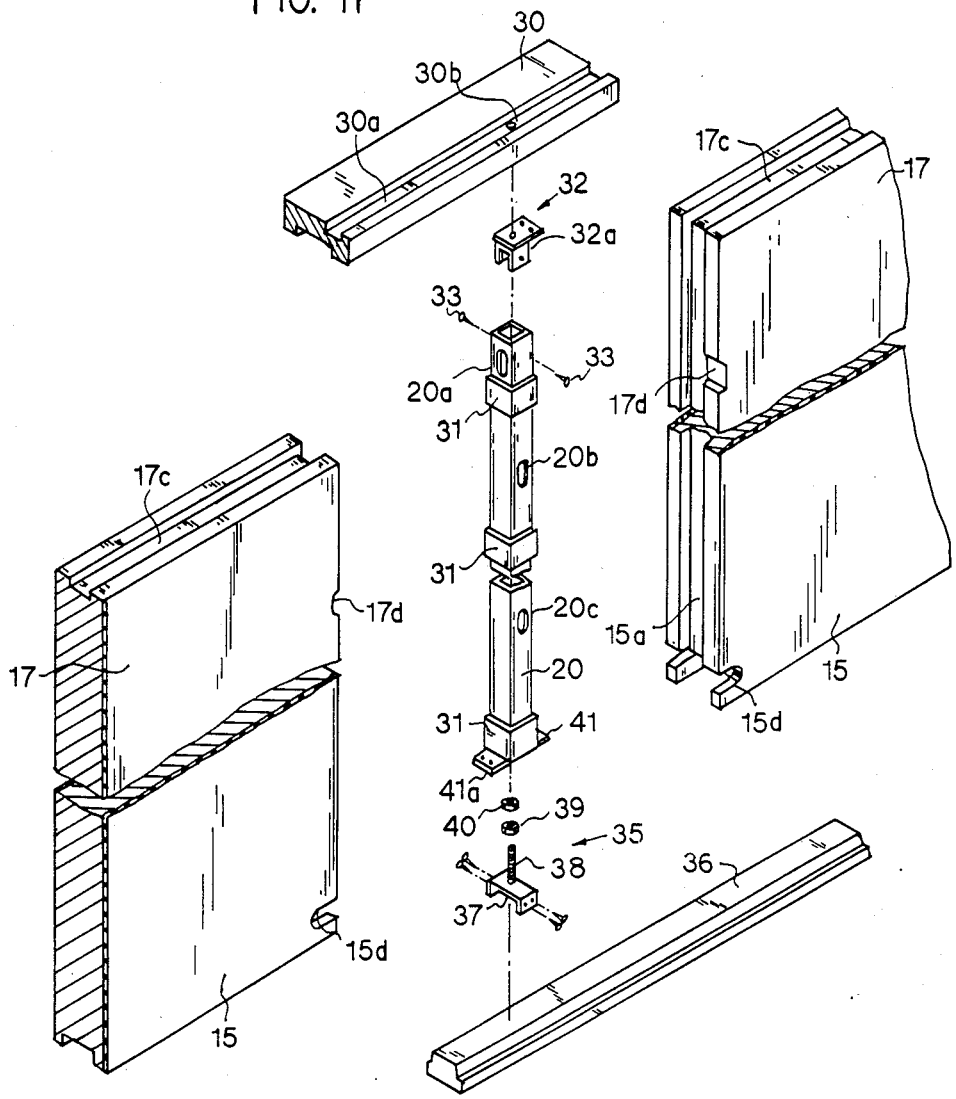
FIG. 11 is an exploded view, partly in section, showing a prefabricated partition wall according to this invention with parts cut away.
Figure 12:
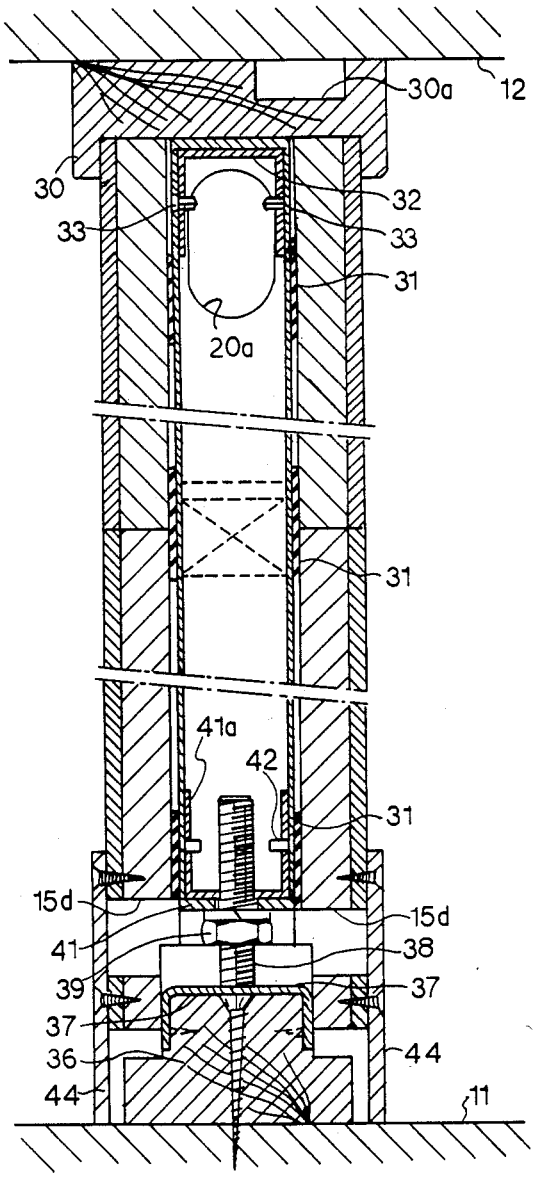
FIG. 12 is a vertical sectional view showing the prefabricated partition wall shown in FIG. 11 in its assembled condition.

Referring to FIGS. 11 and 12, the joint tube 20 is made of a metal such as a steel and rectangular in cross-section, corresponding to the shape of the vertical grooves of the panels 15, 17. Both ends of the tube 20 are open. A through-hole 20*a* is formed in an upper end portion of the tube 20 for one or more electric wires or the like (not shown) which are arranged in an upper groove 17*c* of the panel 17 and/or a groove 30*a* of an elongate upper support 30 fixed on the ceiling 12. The electric wires are also arranged in the joint tube(20). The upper support 30 has a vertical through-hole 30*b*. Also, two other through-holes 20*b*, 20*c* are formed in an intermediate portion of the tube 20 so as to connect the electric wires or the like to a plug socket (not shown). Plural resilient members 31 made of hard rubber are secured to the tube 20.

A fixture 32 has two legs 32*a* fixed to the upper open end of the tube 20 by means of screws 33. The fixture 32 is fixed to the upper support 30 by means of screws (not shown).

An adjustor 35 is set between the lower open end of the tube 20 and an elongate lower support 36 fixed on the floor 11. The adjustor 35 has a base 37 fixed to the lower support 36, a male screw 38 fixed to and extending upwardly from the base 37, a nut 39, a washer 40 and an attachment 41 having a pair of wing portions 41*b* for supporting a lower corner portion 15*d* of the panels 17 and two legs 41*a* which are fixed in the lower open end of the joint tube 20 by screws 42.

As shown in FIGS. 1 and 12, two skirting boards 44 are fixed along the base of the parition wall 10.

Figure 13:
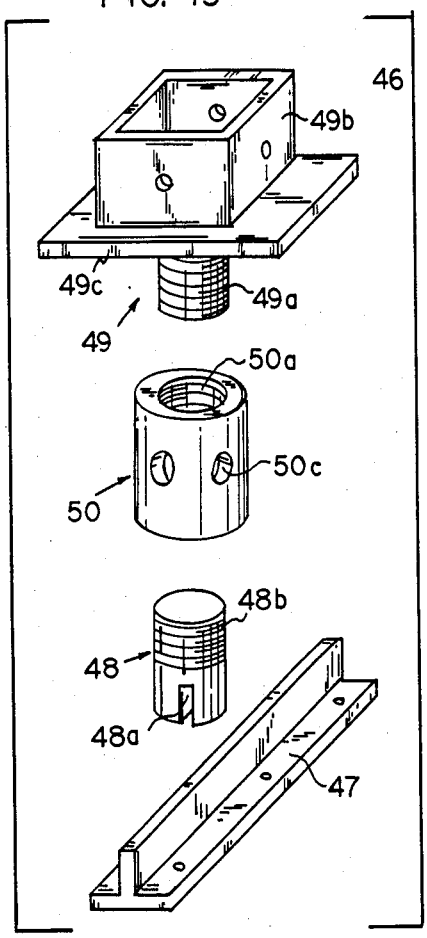
FIG. 13 is an exploded perspective view showing a modified adjustor to be used for a partition wall according to this invention.
Figure 14:
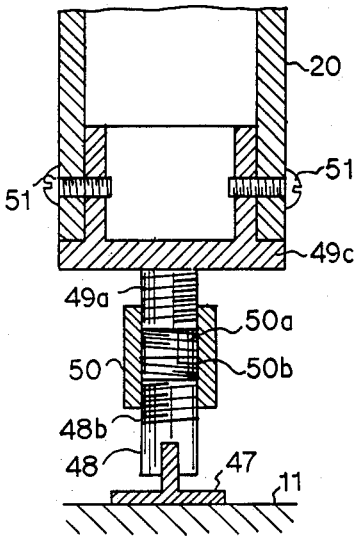
FIG. 14 is a vertical sectional view showing the adjustor of FIG. 13. in its assembled condition.

FIGS. 13 to 14 show a modified adjustor 46 and a lower support 47 which is fixed on the floor 11 for supporting the adjustor 46. The adjustor 46 has a first member 48, a second member 49 and a third member 50. The first member 48 has a groove 48*a* supported by the lower support 47 and a male screw portion 48*b*. The second member 49 has a male screw portion 49*a*, a flange portion 49*c* and a joint portion 49*b* fixed thereto. The joint portion 49*b* is fixed to the lower open end of the joint tube 20 by means of male screws 51. The lower end of the joint tube 20 and the bottom corner of the panels are supported by the flange portion 49*c* of the second member 49. The male screw portion 48*b* of the first member 48 and the male screw portion 49*a* of the second member 49 engage, respectively, female screw portions 50*a* and 50*b* of the third member 50. As the two female screw portions 50*a* and 50*b* have the opposite threads to each other, the third member 50 may be turned so as to adjust the joint tube 20 and the panels in a vertical direction. For such a purpose, four holes 50*c* are formed in the third member 50 so as to permit a screw driver (not shown) to be inserted into one or two of them.

Figure 15:
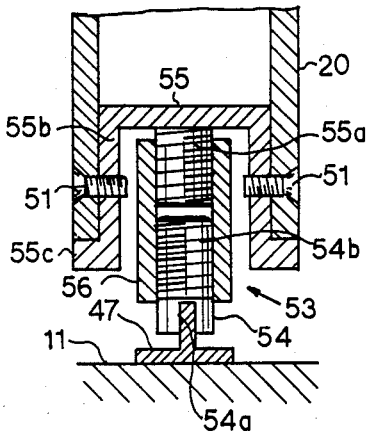
FIG. 15 is a vertical sectional view showing another adjustor for use in a partition wall according to this invention.
Figure 16:
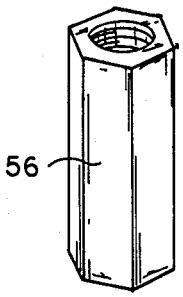
FIG. 16 is a perspective view showing a member of the adjustor shown in FIG. 15.

FIGS. 15 and 16 show still another adjustor 53 to be set between the floor 11 and the joint tube 20.

The adjustor 53 has a first member 54 having a groove 54*a* and a male screw 54*b*, a second member 55 having a male screw 55*a*, a joint portion 55*b* and a flange portion 55*c*, and a third member 56 having two opposite threads engaging the male screws 54*b*, 55*a*. The flange portion 55*c* of the second member 55 support both the panels and the joint tube 20. The third member 56 may be turned by a wrench or the like to adjust the vertical position of the joint tube 20 and the panels.

Figure 17:
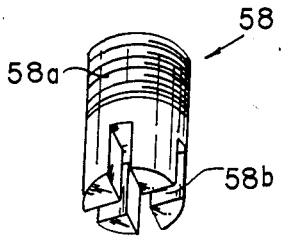
FIGS. 17 and 18 show two different modified members of an adjustor for use in a partition wall according to this invention.
Figure 18:
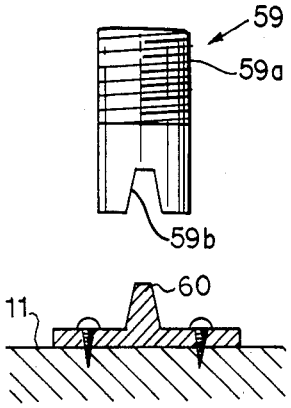

FIGS. 17 and 18 show two modified first members 58, 59 which can be used in the adjustors 46, 53 of FIGS. 13 to 16. The first member 58 has a male screw 58*a* and a cross-shaped groove 58*b*. The first member 59 has a male screw 59*a* and a tapered groove 59*b* supported by a support 60 fixed on the floor 11.

Figure 19:
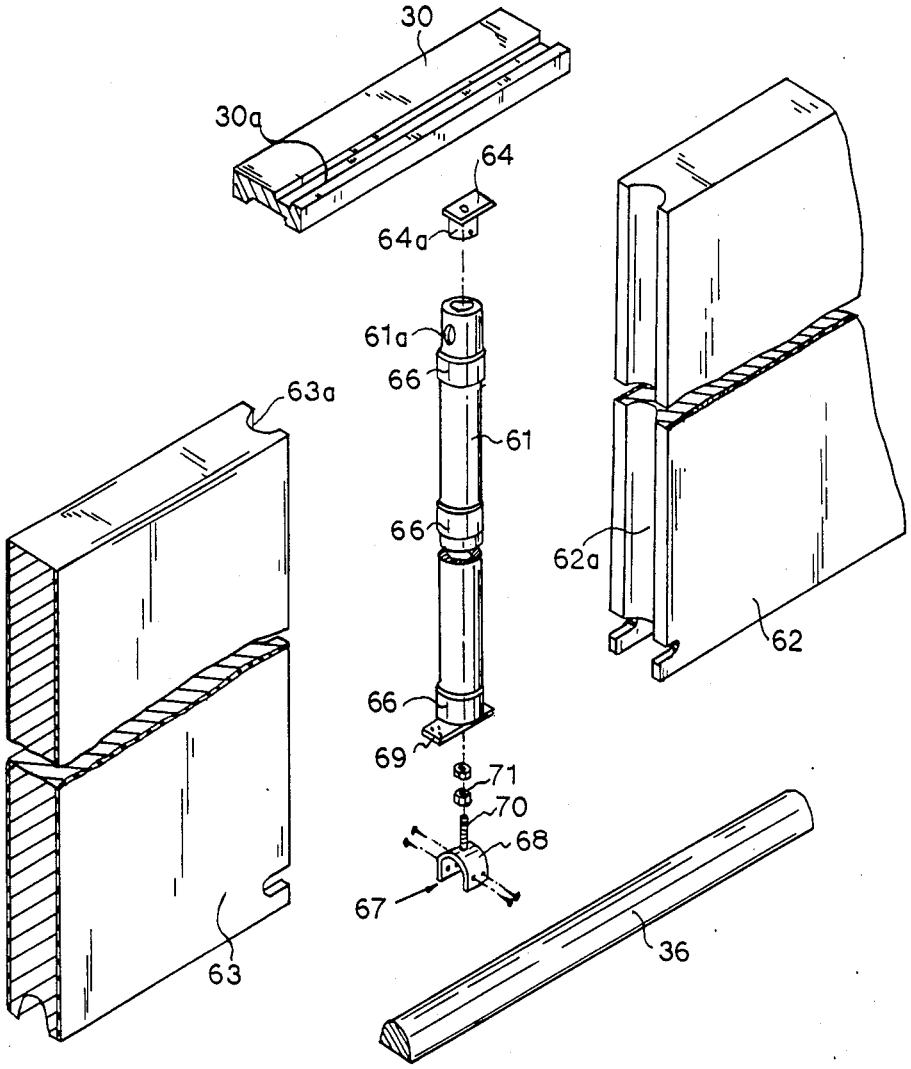
FIG. 19 is an exploded view, partly in section, showing a modified partition wall according to this invention with parts cut away for clarity.

FIG. 19 shows a partition wall according to a second embodiment of this invention which is substantially the same as the first embodiment of FIGS. 1 to 18 except the shape of a joint tube 61 and its related members. The joint tube 61 is circular in cross-section. Vertical grooves 62*a*, 63*a* of plural panels 62, 63 are also circular in cross-section, corresponding to the shape of the joint tube 61. A through-hole 61*a* is formed in an upper portion of the joint tube 61 for leading electric wires (not shown) into the joint tube 61 as in the first embodiment. A fixture 64 has a cylindrical leg 64*a* fixed to the upper open end of the joint tube 61. The fixture 64 is fixed to the upper support 30. Plural resilient members 66 are attached to the joint tube 61. An adjustor 67 is set between the lower open end of the joint tube 61 and an elongate lower support 36 of a U-shape in section fixed on the floor 11. The adjustor 67 is the same as the adjustor 35 of FIG. 11 except the configuration of a base 68 and an attachment 69. The base 68 has fixedly a bolt 70 which a nut 71 engages so as to support the joint tube 61 by way of the attachment 69.

Figure 20:
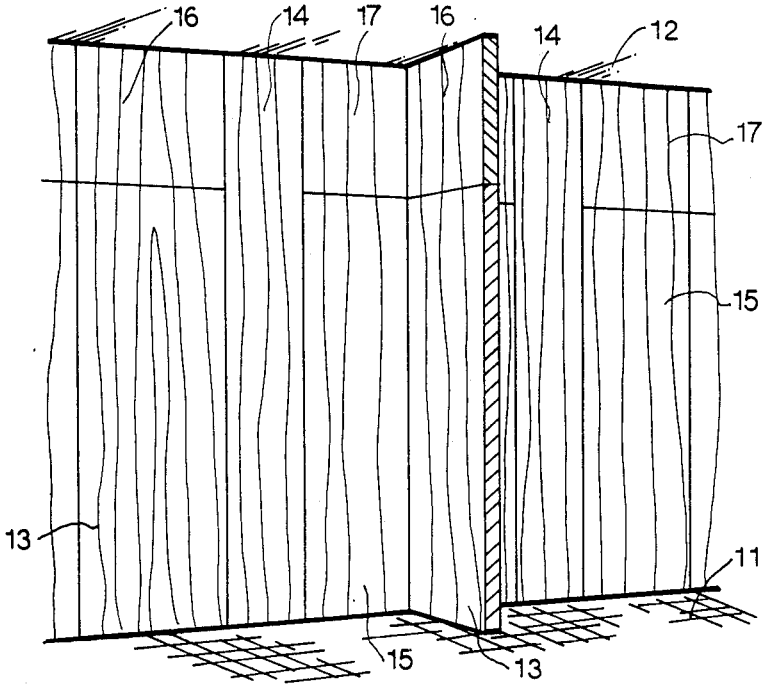
FIG. 20 is a perspective view, partly in section, showing another prefabricated partition wall according to this invention.
Figure 21:
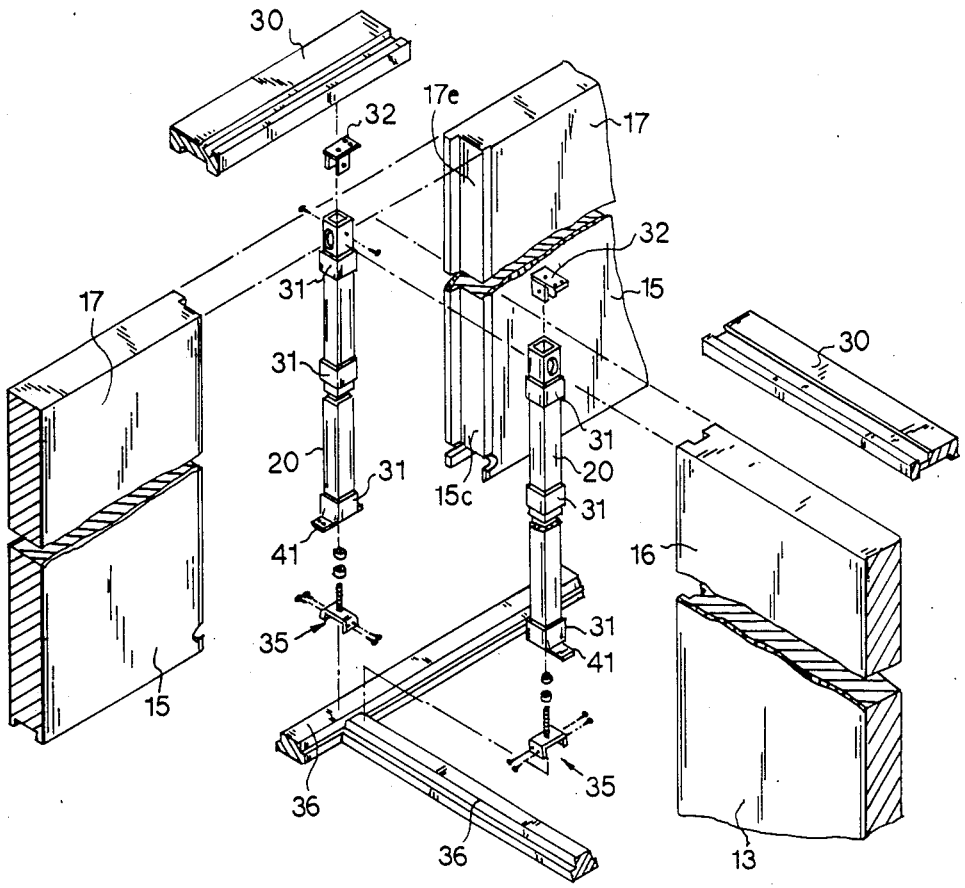
FIG. 21 is an exploded view of the partition wall shown in FIG. 20.
Figure 22:
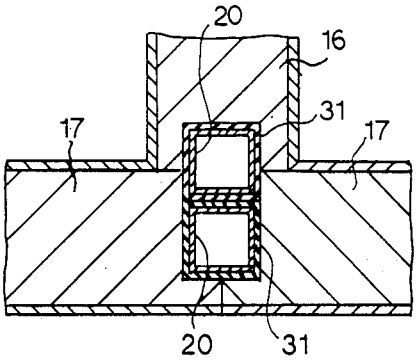

FIGS. 20 to 22 show a partition wall according to a third embodiment of this invention. The partition wall is arranged in a T-shape by plural panels 13 to 17, plural joint tubes 20, plural fixtures 32, plural adjustors 35 and so on as shown in FIGS. 1 to 18. Only the panels 17 are slightly modified at one edge 17*e* thereof so as to be formed in a L-shape whereby two joint tubes 20 are arranged adjacent to each other as best shown in FIG. 22. Except this point, the third embodiment is substantially the same as the first embodiment.

As shown in FIGS. 23 to 29, plural panels 13 to 17 may be joined together in any other ways.

Figure 23:
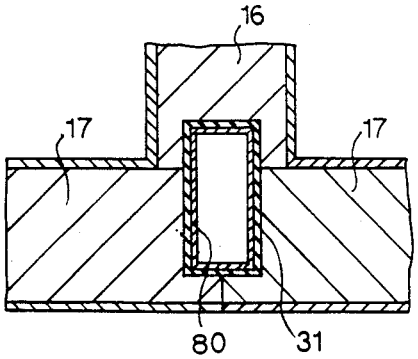

In FIG. 23, a large joint tube 20 corresponding to two joint tubes 20 is used to join the panels 16, 17 together in a T-shape.

Figure 24:
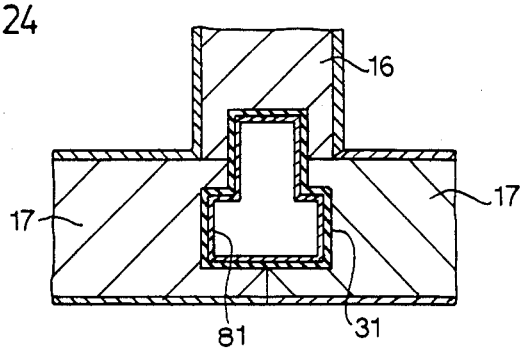

In FIG. 24, a large joint tube 81 of a T-shape in section is used to join the panels 16, 17 in a T-shape.

Figure 26:
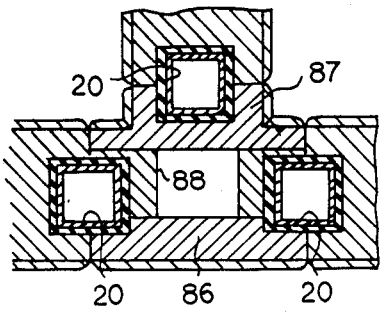
FIGS. 22 to 31 show various modes of joining panels according to this invention.
Figure 25:
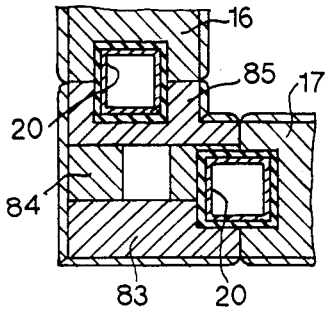
Figure 27:
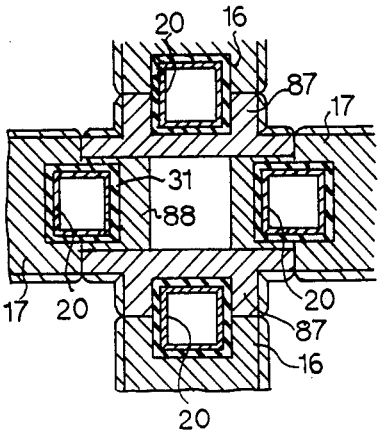

In FIGS. 25 to 27, two or more joint tubes 20 are used to join the panels 16, 17 in a L-shape, T-shape or cross-shape. Also, various auxiliary joint members 83 to 88 are disposed between the plural joint tubes 20.

Figure 28:
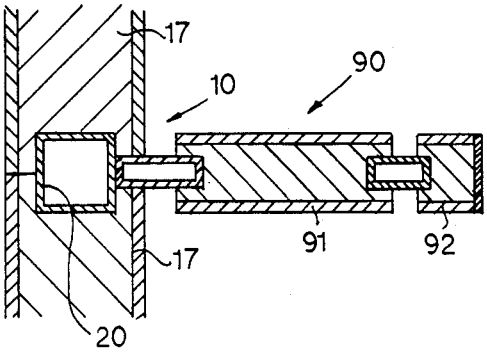
Figure 29:
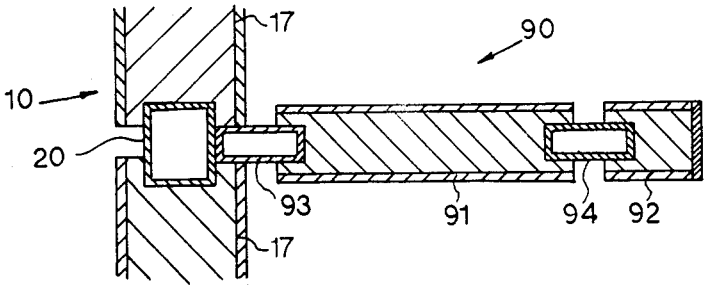

In FIGS. 28 and 29, a side wall 90 of a furniture is joined to the partition wall 10 of FIGS. 1 to 18. Although plural side walls 90 are joined to the partition wall 10 in the same way, only one of them is shown. The side wall 90 is composed of two thin panels 91, 92 and two small joint tubes 93, 94 fitted into vertical grooves thereof. The joint tube 93 is also fitted in a vertical groove formed between the adjacent panels 17 and contacts the joint tube 20.

Figure 30:
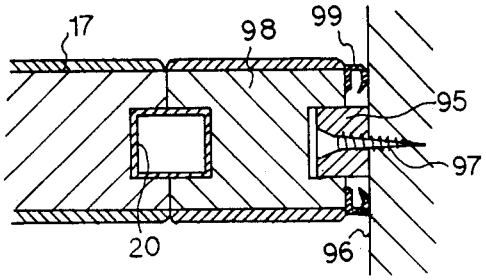
Figure 31:
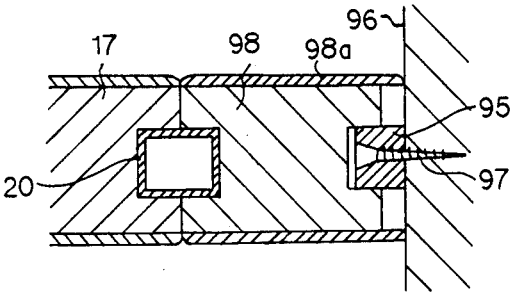

In FIGS. 30 and 31, a stop 95 is fixed to a wall 96 in a room by a wood screw 97. A spacer panel 98 is joined to a side edge of the panel 17 by the joint tube 20 and to the side wall 96 by the stop 95. In FIG. 30, a rubber seal 99 is disposed between the spacer panel 98 and the side wall 96 for noise and light insulations. In FIG. 31, for the same purpose, a thin decorative plate 98*a* of the spacer panel 98 extends to contact the side wall 96.

The operation of assembling the partition walls as above-stated will be explained.

First, the resilient members 31, 66 are attached onto the joint tubes 20, 61, 80, 81. The fixtures 32, 64 and the adjustors 35, 46, 53, 67 are fixed to the joint tubes. Such may be done at a factory.

In a room, the upper and lower supports 30, 36, 47, 60, 68 are fixed on the ceiling 12 and the floor 11, respectively. Thereafter, if desired, the panel 98 (FIGS. 30 and 31) is joined by way of the stop 95 to the wall 96. Then, one joint tube 20 is fittedd into the vertical groove of the panel. The joint tube 20 is further fixed between the upper and lower supports by adjusting the adjustor. The panels 17 and 15 are additionally set along the joint tube 20. The joint tube 20 is further fitted into the other grooves of the panels 15 and 17. Such a cycle is repeated across the room. Finally, the skirting boards 44, the furniture 90, wallpapers (not shown) and so on are fixed, if desired.

The partition walls may be disassembled in the reverse order.

I claim:

1. A prefabricated partition wall for use in a room having a floor and a ceiling, comprising:

an upper support for cooperation with the ceiling;

a lower support for cooperation with the floor;

a metallic joint tube extending vertically and having upper and lower open ends;

a fixture for fixing the upper open end of the joint tube to the upper support;

a plurality of panels each having at both sides thereof a vertical groove of a shape corresponding to that of the joint tube;

an adjustor placed between the lower support and the lower open end of the joint tube for supporting the joint tube and the panels at their bottom portion in such a manner that the adjustor can be actuated to adjust the joint tube and the panels together in a vertical direction so as to fix securely them in position between the floor and the ceiling;

a plurality resilient sleeve members attached to the joint tube in such a way that the resilient sleeve members are disposed between the joint tube and the panels in the vertical grooves;

said adjustor comprising a first member set on the lower support and having a male screw, a second member fixed to the lower end of the joint tube and having a male screw and a third member having a pair of female screws threaded reversely to each other and engaging the male screws of the first and second members so that the third member can be turned so as to adjust the distance between the first member and the second member;

the lower support being formed in a T-shape with an upwardly extending projection;

the first member of the adjustor having a groove for cooperation with the projection of the lower support to prevent the first member from turning;

the second member having a flange portion for supporting the bottom corners of the panels and a joint portion fixed to the flange portion and joined to the lower open end of the joint tube;

at least one of the panels including a door unit having a door hinged thereto between the vertical grooves.

2. A prefabricated partition wall as defined in claim 1, wherein the joint tube is rectangular in cross-section.

3. A prefabricated partition wall as defined in claim 2, further comprising a furniture having a side wall comprising thin panels having at both sides thereof a vertical groove of a shape corresponding to that joint of the tube, and small joint tube members extending vertically fitted in the vertical grooves of the thin panel members, and wherein one of the small joint tube members is fitted in a groove between adjacent panels and contacts the joint tube joining the two adjacent panels.

4. A prefabricated partition wall as defined in claim 2, further comprising three panels joined in a T-shape by two joint tubes.

5. A prefabricated partition wall as defined in claim 2, further comprising three panels joined in a T-shape by a single joint tube.

6. A prefabricated partition wall as defined in claim 1, further comprising three panels joined in a T-shape by a single joint tube of a T-shape.

7. A prefabricated partition wall as defined in claim 1, further comprising three panels joined in a T-shape, L-shape or cross-shape by two or more joint tubes and plural auxiliary joint members.

8. A prefabricated partition wall as defined in claim 1, wherein the joint tube (20, 61) has a through-hole (**20*a*, 61*a***) at its upper portion for an electric wire which is arranged along the upper support and within the joint tube.

* * * * *